US006164823A

United States Patent [19]

Donnell

[11] Patent Number: 6,164,823

[45] Date of Patent: Dec. 26, 2000

[54] VALVE BAG AND METHOD FOR MAKING A VALVE BAG

[75] Inventor: Roy H. Donnell, Brandon, Miss.

[73] Assignee: Southern Bag Corporation, Ltd., Madison, Miss.

[21] Appl. No.: 09/206,473

[22] Filed: Dec. 7, 1998

[51] Int. Cl.[7] ..... B65D 30/24

[52] U.S. Cl. ..... 383/48; 383/52; 383/54; 428/35.5; 428/34.3; 428/35.2; 493/213; 493/272

[58] Field of Search ..... 383/54, 48, 52, 383/56, 107; 493/213, 272; 428/35.2, 35.5, 34.2, 34.3

[56] References Cited

U.S. PATENT DOCUMENTS

| | | | |
|---|---|---|---|
| 2,031,915 | 2/1936 | Verwys | 150/9 |
| 2,040,335 | 5/1936 | Rosmait | 150/9 |
| 2,147,970 | 2/1939 | Du Bois | 229/62.5 |
| 2,478,113 | 8/1949 | Lee | 229/62.5 |
| 2,651,451 | 9/1953 | Bennett | 229/62.5 |
| 2,891,716 | 6/1959 | Lee | 229/62.5 |
| 2,977,038 | 3/1961 | La Fave | 229/62.5 |
| 3,004,698 | 10/1961 | Ashton | 383/54 |
| 3,065,899 | 11/1962 | Means et al. | 229/62.5 |
| 3,130,897 | 4/1964 | Poklukar et al. | 229/62.5 |
| 3,187,984 | 6/1965 | Hollis et al. | 229/62.5 |
| 3,191,850 | 6/1965 | Niemeyer | 229/62.5 |
| 3,261,267 | 7/1966 | Becker | 93/35 |
| 3,318,511 | 5/1967 | Winegard | 229/62.5 |
| 3,894,682 | 7/1975 | Harmsen | 229/62.5 |
| 4,049,191 | 9/1977 | Stearley | 229/62.5 |
| 4,091,986 | 5/1978 | Eberle | 229/62.5 |
| 4,095,736 | 6/1978 | Rothschild, III et al. | 229/62.5 |
| 4,166,482 | 9/1979 | Sanders | 141/1 |
| 4,364,510 | 12/1982 | Buchanan | 229/62.5 |
| 4,367,620 | 1/1983 | Fox | 53/479 |
| 4,391,404 | 7/1983 | Welter | 229/62.5 |
| 4,401,140 | 8/1983 | Vogel | 229/62.5 |
| 4,453,270 | 6/1984 | Donini et al. | 383/115 |
| 4,563,231 | 1/1986 | Porrmann et al. | 493/272 |
| 4,708,705 | 11/1987 | Aubry et al. | 493/213 |
| 4,759,640 | 7/1988 | Gröner | 383/44 |
| 4,930,904 | 6/1990 | Gröner et al. | 383/45 |
| 5,516,210 | 5/1996 | Kelley et al. | 383/54 |
| 5,806,982 | 9/1998 | Kelley et al. | 383/54 |

FOREIGN PATENT DOCUMENTS

| | | |
|---|---|---|
| 34606 | 4/1973 | Australia . |
| 0 332 549 | 9/1989 | European Pat. Off. . |
| 0 498 047 A1 | 8/1992 | European Pat. Off. . |
| 2 228 004 | 11/1974 | France . |
| 2 303 727 | 3/1976 | France . |
| 1212856 | 3/1966 | Germany . |
| 1436838 | 7/1969 | Germany . |
| 2218867 | 10/1973 | Germany . |
| 25 19 494 | 11/1976 | Germany . |
| 3203187 | 1/1982 | Germany . |
| 32 09 280 | 9/1983 | Germany . |
| 8 005 262 | 9/1980 | Netherlands . |
| 2 031 374 | 4/1980 | United Kingdom . |
| WO 92/06014 | 4/1992 | WIPO . |

*Primary Examiner*—Stephen P. Garbe
*Attorney, Agent, or Firm*—Marshall, O'Toole, Gerstein, Murray & Borun

[57] ABSTRACT

A valve bag has a sleeve that includes a butt seam formed by abutting opposed edges of a paper sheet and securing the abutting edges. A strip of tape may be used to secure the abutting edges. The interior surface of the sleeve and the tape are both constructed from a sealable material. A tight seal is achieved when the sleeve is sealed.

20 Claims, 1 Drawing Sheet

VALVE BAG AND METHOD FOR MAKING A VALVE BAG

BACKGROUND OF THE INVENTION

1. Field of the Invention

The invention relates generally to valve bags and, more specifically, the invention relates to valve sleeves used to fill and seal valve bags, such as shipping sacks that are used to contain and transport granular products (e.g., fertilizer, cement, animal feeds, or grains).

2. Description of Related Technology

Flexible bags such as paper shipping sacks may include sealable sleeves placed in the filling valves. A sealable sleeve provides a convenient means to and securely close the flexible bag to prevent the contents of the bag from leaking or sifting out of the bag. Sleeves may be constructed of polyethylene tubing or of paper, for example.

A typical paper sleeve for a paper shipping sack (such as a pasted valve type multiwall shipping sack) is made from a rectangular sheet of kraft paper that is rolled into a cylindrical shape and secured in the cylindrical shape by overlapping and gluing opposing edges of the sheet of paper to one another, forming a lapped seam. Such a sleeve is typically mounted to an opening, called a valve or filling aperture, located in a corner of the bag, that is used to allow introduction of the product that is to be held within the bag. This arrangement has been used even in more advanced shipping sacks that include a thermoplastic film liner adhered to the inner surface of the sleeve valve. In order to seal the paper sleeve and therefore the valve or filling aperture after the shipping sack is full, heat is applied to the thermoplastic film liner near an exterior end of the sleeve valve to secure the contents within the shipping sack. Sealing is typically accomplished using conduction heating, pressure, microwave energy, or ultrasonic application.

However, due to the double thickness of paper formed by the overlapping edges of paper forming the lapped seam of the sleeve, a gap is often present in the vicinity of the lapped seam of the sleeve after sealing, due to the discontinuity in the thickness of the sleeve at the edge of the paper that is disposed on the interior surface of the lapped seam. The discontinuity in the thickness of the sleeve impedes sealing and makes it possible for the contents of the bag to leak or sift out of the bag even after the valve has been sealed.

SUMMARY OF THE INVENTION

A sleeve for a flexible bag constructed in accordance with the invention includes a butt seam that is formed by abutting opposite edges of a sheet and securing the abutting edges. Means are provided to secure the abutting edges. Preferably, the interior surface of the sleeve and the securing means are constructed from a sealable material.

A flexible bag having a sleeve constructed in accordance with the invention will prevent contents of the flexible bag from escaping due to incomplete sealing of the sleeve.

Other advantages and features of the invention will be apparent to those skilled in the art from a review of the following detailed description taken in conjunction with the drawings and the appended claims.

DETAILED DESCRIPTION OF THE INVENTION

Figure 1:
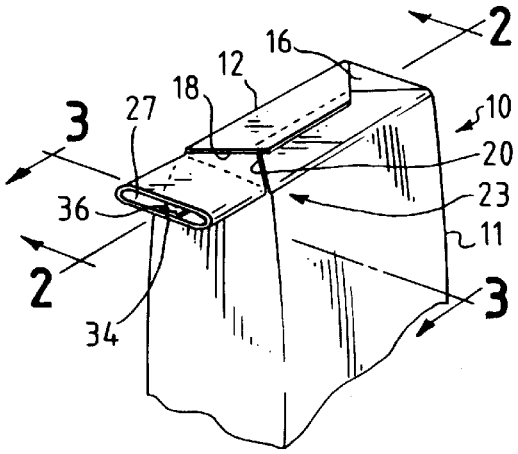
FIG. 1 is a perspective view of a flexible bag having a sleeve constructed in accordance with the invention.
Figure 2:
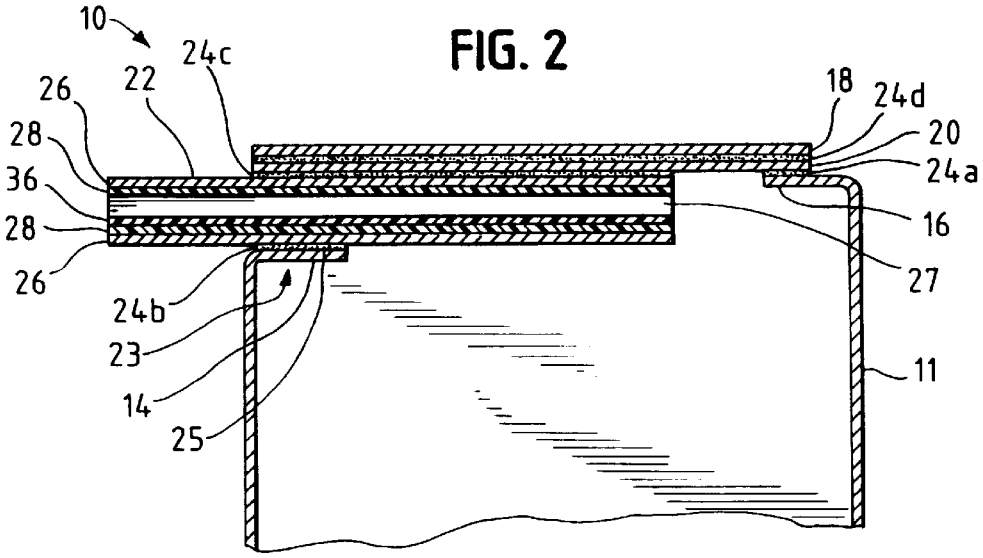
FIG. 2 is a cross-sectional view of the flexible bag and the sleeve of FIG. 1, taken along lines 2—2 of FIG.

As seen in FIGS. 1 and 2, a flexible bag, generally designated 10, includes a sack 11 having an end 12 that includes a front flap 14 (seen in FIG. 2), a rear flap 16, a first side flap 18, and a second side flap 20. The flexible bag 10 is preferably a pasted valve type multiwall shipping sack.

The flexible bag 10 also includes a sleeve mounted in a filling aperture 25 formed in a corner, generally designated 23, of the sack portion 11. The filling aperture 25 is defined between the front flap 14 and the first and second side flaps 18 and 20, respectively. The filling aperture 25 allows introduction of the product (not shown) that is to be held within the flexible bag 10. The sleeve 22 is disposed in the vicinity of the corner 23, within the filling aperture 25 and defines a valve opening 27.

The sack 11 preferably is constructed of relatively stiff paper, such as kraft paper, and preferably includes multiple layers, for example, about 2 to 6 layers. For simplicity, however, the sack 11 is depicted in the figures as being made from only a single layer of paper. The drawings (especially the cross-sectional views of FIGS. 2, 3, and 4) are not drawn to scale, in order to depict extremely thin layers, such as adhesive layers and plastic film layers, that form part of the flexible bag 10.

The rear flap 16 is secured to the second side flap 20 in a conventional manner using an adhesive layer 24*a*. Similarly, an adhesive layer 24*b* is used to secure the front flap 14 to the sleeve 22, an adhesive layer 24*c* is used to secure the sleeve 22 to the second side flap 20, and an adhesive layer 24*d* is used to secure the second side flap 20 to the first side flap 18.

Figure 3:
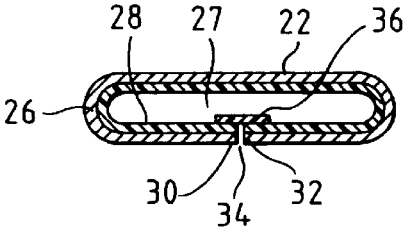
FIG. 3 is a cross-sectional view of the sleeve of FIGS. 1 and 2, taken along lines 3—3 of FIG. 1.

The sleeve 22 preferably is formed from a rectangular sheet of kraft paper 26 having a thermoplastic film 28 that coats one surface thereof (and which forms the interior surface of the sleeve 22). Preferably, the thermoplastic film is a low density polyethylene material that is extruded onto the surface and becomes an integral part of sheet 26. In order to form the sleeve 22, opposite edges 30 and 32 of the sheet of paper 26 are placed in abutment with one another to form a butt seam 34, as best seen in FIG. 3, and a strip of tape 36 is placed over the butt seam 34 to secure the edges 30 and 32 in abutment with one another. Preferably, the strip of tape 36 is made from a sealable thermoplastic material such as low density polyethylene, and is a strip extending along substantially the entire length of the butt seam 34. The strip of tape 36 should have a melting temperature substantially the same as the melting temperature of the thermoplastic material coating the surface of sheet 26.

One will appreciate that sleeve 22 may be constructed by coating a surface of sheet 26 with a thermoplastic film and securing tape 36 to one edge, i.e., one of edges 30 and 32. Edges 30 and 32 are then brought into abutting relationship, with the thermoplastic coating and tape 36 disposed on the interior of sleeve 22. Tape 36 may then be secured to the other of edges 30 and 32 for retaining the edges in abutting relationship.

Figure 4:
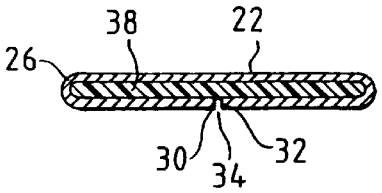
FIG. 4 is a cross-sectional view of the sleeve, similar to FIG. 3, showing the sleeve after sealing has taken place.

As shown in FIG. 4, after the sleeve 22 has been heat sealed, a continuous thermoplastic layer 38, formed from the melting and subsequent solidifying of the strip of tape 36 and the thermoplastic film 28, serves as a barrier to prevent contents of the flexible bag 10 from leaking or sifting out of the flexible bag 10. Because the edges 30 and 32 abut with one another to form the butt seam 34, the thermoplastic layer 38 does not include a gap that would otherwise be present if the edges 30 and 32 overlapped one another to form a lapped seam. Such a gap is absent due to the lack of a discontinuity in the thickness of the sleeve valve 22 in the vicinity of the edges 30 or 32. Accordingly, a tight seal is achieved because there is no discontinuity that would impede sealing.

The foregoing describes a preferred embodiment of the invention, and various changes and modifications can be made thereto without departing from the scope of the invention, which is defined by the appended claims.

What is claimed is:

1. A sealable sleeve for a filling aperture of a valve bag, the sleeve comprising:

a sheet having a first edge and a second edge placed in abutment with one another to form a butt seam and further defining an interior surface and an exterior surface of the sleeve;

a heat sealable material coating the interior surface; and a heat sealable tape consisting essentially of a material having a melting temperature substantially the same as a melting temperature of the heat sealable material, disposed over the heat sealable material and over the butt seam, the heat sealable tape securing the first edge and the second edge in abutting relationship.

2. The sleeve of claim 1, wherein the heat sealable material comprises a thermoplastic material.

3. The sleeve of claim 2, wherein the thermoplastic material comprises a low density polyethylene material.

4. The sleeve of claim 1, wherein the heat sealable tape extends over substantially an entire length of the butt seam.

5. The sleeve of claim 1, wherein the sheet comprises paper.

6. The sleeve of claim 1, wherein the sheet comprises kraft paper.

7. The sleeve of claim 6, wherein the heat sealable tape comprises a thermoplastic tape having a melting temperature substantially equal to a melting temperature of the heat sealable material.

8. The sleeve of claim 7, wherein the heat sealable tape comprises a low density polyethylene tape.

9. A valve bag comprising:

a sack having an end that includes a front flap, a rear flap, a first side flap, and a second side flap;

a sleeve attached to at least one of said front flap, said rear flap, said side flap and said second side flap, and wherein said front flap, said rear flap and said first and second side flaps define a filling aperture, said sleeve being formed from a sheet having a first edge and a second edge placed in abutment with one another to form a butt seam and defining an interior and an exterior surface of the sleeve, the interior surface being coated with a heat sealable material; and a heat sealable tape disposed over the heat sealable material and over the butt seam, the heat sealable tape securing the first edge and the second edge in abutting relationship.

10. The valve bag of claim 9, wherein the heat sealable material comprises a thermoplastic material.

11. The valve bag of claim 10, wherein the thermoplastic material comprises a low density polyethylene material.

12. The valve bag of claim 9, wherein the heat sealable tape extends over substantially an entire length of the butt seam.

13. The valve bag of claim 9, wherein the sheet comprises paper.

14. The valve bag of claim 9, wherein the sheet comprises kraft paper.

15. The valve bag of claim 9, wherein the heat sealable tape comprises a thermoplastic tape having a melting temperature substantially equal to a melting temperature of the heat sealable material.

16. The valve bag of claim 15, wherein the heat sealable tape comprises a low density polyethylene tape.

17. A method of constructing a sleeve for a valve bag, the method comprising the steps of:

providing a sheet having a first edge and a second edge;

coating a surface of the sheet with a heat sealable material;

securing a heat sealable tape along one of the first edge and the second edge, the heat sealable tape consisting essentially of a material having a melting temperature substantially the same as a melting temperature of the heat sealable material;

placing the first edge in abutment with the second edge to form a butt seam and with the surface disposed on an interior of the sleeve; and securing the heat sealable tape to the other of the first edge and the second edge.

18. A sealable sleeve for a filling aperture of a valve bag, the sleeve comprising:

a kraft paper sheet having a first edge and a second edge placed in abutment with one another to form a butt seam and further defining an interior surface and an exterior surface of the sleeve;

a heat sealable material coating the interior surface; and a heat sealable tape disposed over the heat sealable material and over the butt seam, the heat sealable tape securing the first edge and the second edge in abutting relationship.

19. The sealable sleeve of claim 18, wherein the heat sealable tape comprises thermoplastic tape having a melting temperature substantially equal to a melting temperature of the heat sealable material.

20. The sealable sleeve of claim 19, wherein the heat sealable tape comprises a low density polyethylene tape.

* * * * *